US007229328B2

(12) United States Patent
Sawada et al.

(10) Patent No.: US 7,229,328 B2
(45) Date of Patent: Jun. 12, 2007

(54) FEMALE CONTACT

(75) Inventors: Takao Sawada, Osaka (JP); Keichiro Ikuta, Osaka (JP); Masato Wada, Osaka (JP)

(73) Assignee: J.S.T. MFG. Co. Ltd., Osaka (JP)

( * ) Notice: Subject to any disclaimer, the term of this patent is extended or adjusted under 35 U.S.C. 154(b) by 0 days.

(21) Appl. No.: 11/016,568

(22) Filed: Dec. 17, 2004

(65) Prior Publication Data

US 2005/0164567 A1 Jul. 28, 2005

(30) Foreign Application Priority Data

Dec. 19, 2003 (JP) ..... 2003-421928

(51) Int. Cl.
*H01R 11/22* (2006.01)

(52) U.S. Cl. ..... 439/852; 439/595

(58) Field of Classification Search ..... 439/851, 439/852, 856, 857, 853, 854, 595, 850
See application file for complete search history.

(56) References Cited

U.S. PATENT DOCUMENTS

| | | | | |
|---|---|---|---|---|
| 3,918,784 | A | 11/1975 | Lemke et al. | |
| 4,342,498 | A | 8/1982 | Patton et al. | |
| 4,880,401 | A * | 11/1989 | Shima et al. | 439/746 |
| 5,226,842 | A * | 7/1993 | Endo et al. | 439/843 |
| 5,269,712 | A * | 12/1993 | Denlinger et al. | 439/845 |
| 5,536,186 | A * | 7/1996 | Watanabe | 439/843 |
| 5,601,458 | A * | 2/1997 | Ohsumi et al. | 439/852 |
| 6,152,788 | A * | 11/2000 | Hata et al. | 439/852 |
| 6,524,143 | B2 * | 2/2003 | Chen | 439/852 |
| 6,527,601 | B2 * | 3/2003 | Chen | 439/852 |
| 2003/0096540 | A1 * | 5/2003 | Smyk | 439/843 |

FOREIGN PATENT DOCUMENTS

| | | |
|---|---|---|
| EP | 0 977 317 A2 | 2/2000 |
| EP | 1 215 764 A2 | 6/2002 |
| EP | 1 313 174 A2 | 5/2003 |
| EP | 1 313 174 A3 | 5/2003 |

OTHER PUBLICATIONS

European Search Report dated Mar. 8, 2005, 2 pages.
Australian Patent Office Search Report; Dated Aug. 19, 2005, 4 pages.

* cited by examiner

*Primary Examiner*—Phuong Dinh
(74) *Attorney, Agent, or Firm*—Osha Liang LLP

(57) ABSTRACT

A female contact comprises a tube-shaped socket having a male-contact accommodation space, and a flat spring held in the socket so as to apply elastic force to a male contact. A notch is formed at a male-contact inlet of the socket. A hook formed at one end of the flat spring is engaged with the notch, so that the flat spring is latched at the male-contact inlet.

10 Claims, 13 Drawing Sheets

FEMALE CONTACT

BACKGROUND OF THE INVENTION

1. Field of the Invention

The present invention relates to a female contact that has a socket for removably accommodating a male contact such as plug or pin-type terminal so that an electrical contact occurs therebetween, and more specifically relates to a female contact that has a flat spring held in its socket.

2. Description of Related Art

In a known technique (Japanese Patent Unexamined Publication No. 55-111082), a female contact has a socket for accommodating a male contact such as plug or pin-type terminal. The female contact includes, in its socket, a flat spring whose elastic force is exerted on a male contact accommodated in the socket, thereby keeping good electrical contact with the male contact.

According to the foregoing technique, a female contact 501 (see FIG. 13) is manufactured through a process such as bending and cutting a metal flat plate 601 (see FIG. 10). In FIGS. 10 to 12, base elements that are intended to form respective parts of the female contact 501 of FIG. 13 are each denoted by a reference number of six-hundred-something that is higher by 100 than a reference number of five-hundred-something denoting its corresponding part in FIG. 13.

The flat plate 601 shown in FIG. 10 includes, from left to right in the drawing sheet, a spring element 620, a socket element 610, a conductor crimper element 630, and an insulator crimper element 631. The spring element 620 is elongated in a horizontal direction of FIG. 10. The socket element 610 has a substantially square shape and is connected, in the middle of one edge thereof, with the spring element 620. In the middle of an opposite edge of the socket element 610, the conductor crimper element 630 is connected with the socket element 610 via a connecting portion 630*a*. The conductor crimper element 630 is elongated in a direction perpendicular to an elongation direction of the spring element 620. The insulator crimper element 631 is connected with the conductor crimper element 630 via a connecting portion 631*a* that locates opposite to the connecting portion 630*a* across the conductor crimper element 630. The insulator crimper element 631 is more elongated in the direction perpendicular to the elongation direction of the spring element 620 than the conductor crimper element 630 is. The spring element 620 has, in the vicinity of its free end, three pairs of projections 621, 622, and 623, which are paired in a widthwise direction of the spring element 620, respectively. The socket element 610 has an opening 610*b* in its center to form a tongue 610*a* that extends in the horizontal direction of FIG. 10.

In the following description, a direction running perpendicularly through the drawing sheet of FIG. 10 is defined as a "vertical direction", and a face of the flat plate 601 visible in FIG. 10 is defined as a "surface".

First, the spring element 620 is bent into such a shape as shown in FIG. 11. More specifically, the spring element 620 is bent 180 degrees towards the socket element 610 so as to establish a surface-to-surface contact between the socket element 610 and a front portion of the spring element 620 including the projections 621, 622, and 623. Then, a portion of the spring element 620 confronting the socket element 610, which means the front portion including the projections 621, 622, and 623, is bent into a convex shape protruding upward, in such a manner that the pair of projections 622 confronts the opening 610*b* of the socket element 610 and at the same time locates at a top of the convex. Then, a front end of the spring element 620 is bent upward so that its under surface can be in contact with a surface of the socket element 610. Here, a portion 620*x*, which is a part of the spring element 620 other than the convex portion, i.e., other than the front portion including the projections 621, 622, and 623, is folded so that surfaces of its folded two parts contact with each other along substantially on the same plane as the socket element 610 and other elements which have not been bent yet.

The tongue 610*a* illustrated in FIG. 10 is bent downward, thus forming a latch member 510*a* (see FIG. 11) that latches the female contact 501 to a non-illustrated housing that houses the female contact 501 therein.

Next, the socket element 610, the conductor crimper element 630, the insulator crimper element 631, the connecting portion 630*a*, and the connecting portion 631*a* are bent into respective shapes as shown in FIG. 12. To be more specific, these elements are bent along alternate long and short dash lines and alternate long and two short dashes lines illustrated in FIG. 10, thereby forming a socket 510. The socket 510 has a substantially rectangular-cylindrical shape whose bottom wall 511, side walls 512, and top wall 513 shown in FIG. 12 are constituted by respective portions 611, 612, 613*x*, and 613*y* illustrated in FIG. 10. The portions 613*x* and 613*y* are connected with their front edges abutting each other. The conductor crimper element 630 and the insulator crimper element 631 illustrated in FIG. 10 are respectively formed into a conductor crimper 530 and an insulator crimper 531, each of which has a U-like shape with its top opened. The connecting portions 630*a* and 631*a* illustrated in FIG. 10 are also shaped U-like with its top opened, thus forming a connecting portions 530*a* and 531*a*, respectively.

In the state shown in FIG. 12, the projections 621 and 623 of the spring element 620 are in contact with inner faces of the side walls 512, and the projections 622 of the spring element 620 are engaged with the opening 510*b*.

In FIG. 12, the parts corresponding to the respective elements 610, 630, 631, 630*a*, and 631*a* illustrated in FIG. 10 are already in finished forms, and therefore denoted by the respective reference numbers 510, 530, 531, 530*a*, and 531*a*, which are the same as in FIG. 13.

Finally, a portion of the spring element 620 extending out of the socket 510 in FIG. 12, i.e., the portion 620*x* which is a part of the spring element 620 other than the convex portion, is cut away. The remaining convex portion of the spring element 620 forms a flat spring 520 as shown in FIG. 13, thus completing the female contact 501 that has the flat spring 520 held in its socket 510.

After the cutaway process, the projections 621, 622, and 623 in FIG. 12 provided at the convex portion of the spring element 620 becomes constituent parts of the flat spring 520. In FIG. 13, accordingly, the parts corresponding to the projections 621, 622, and 623 are denoted by the reference numbers 521, 522, and 523, respectively.

In the female contact 501 shown in FIG. 13, the flat spring 520 is latched to the socket 520 via the projections 522 alone. One end of the flat spring 520 at a male-contact inlet of the socket 510, which is provided at a left side of the socket 510 in FIG. 13, is in contact with the bottom wall 511 of the socket 510 but is not latched to the socket 510.

SUMMARY OF THE INVENTION

In an apparatus mounted with the female contact 501, deformation of the flat spring 520 sometimes occurs during a continuity check, etc. For example, a checking rod, which is inserted through the male-contact inlet located leftward in FIG. 13 into the socket 510 for checking continuity, may be in contact with one end of the flat spring 520 at the male-contact inlet or may enter between the flat spring 520 and the bottom wall 511 of the socket 510. This may cause deformation of the one end of the flat spring 520 which is not latched to the socket 510, and thus elasticity of the flat spring 520 can often be deteriorated. As a result, a male contact accommodated in the socket 510 cannot receive adequate elastic force and therefore cannot be securely held therein. This disadvantageously prevents the flat spring 520 from demonstrating its own function, that is, keeping good electrical contact with the male contact.

An object of the present invention is to provide a female contact that can prevent deterioration in elasticity of a flat spring held in a socket.

According to the present invention, there is provided a female contact comprising: a tube-shaped socket having a wall that defines a male-contact accommodation space and also having, at its one end, a male-contact inlet in the vicinity of which a first hole is formed; and a flat spring that is held in the accommodation space so as to apply elastic force to a male contact received in the accommodation space, the flat spring having its one end positioned at the male-contact inlet and having, in the vicinity of the one end, a first protrusion engageable with the first hole.

With the foregoing construction, the first protrusion of the flat spring and the first hole of the socket are engaged with each other, thereby latching the flat spring to the socket. Thus, the flat spring is, via its first protrusion, latched in the vicinity of the male-contact inlet of the socket. Accordingly, even if a checking rod, which is inserted through the male-contact inlet into the socket for checking continuity, is in contact with one end of the flat spring at the male-contact inlet, the flat spring is unlikely to deform and therefore can be prevented from deteriorating in elasticity.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, a certain preferred embodiment of the present invention will be described in conjunction with the accompanying drawings.

Figure 1:
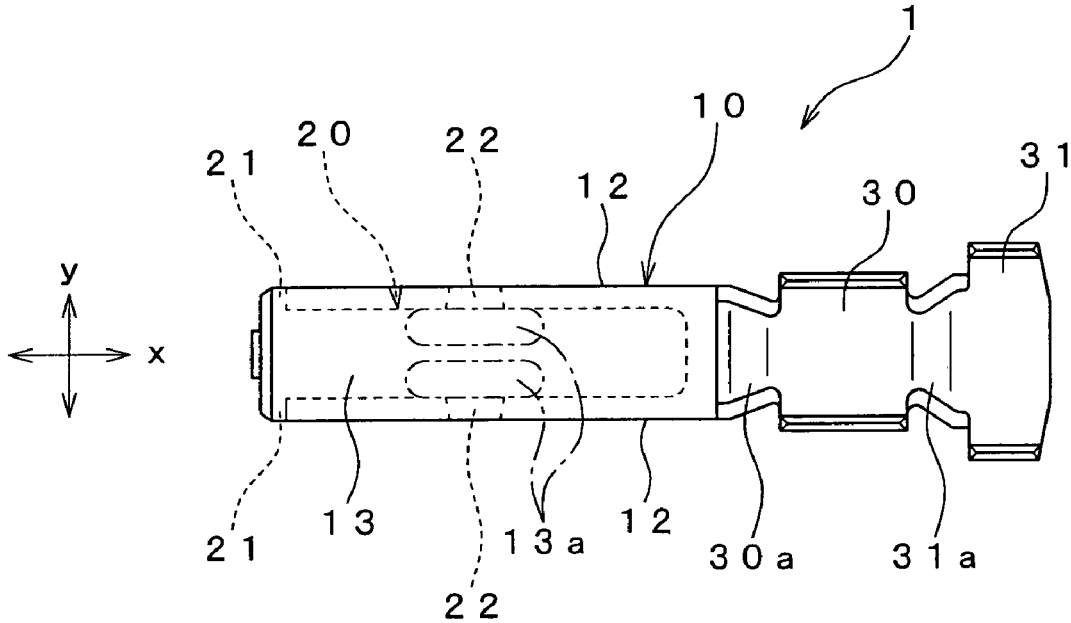
FIG. 1 is a plan view of a female contact according to an embodiment of the present invention.
Figure 2:
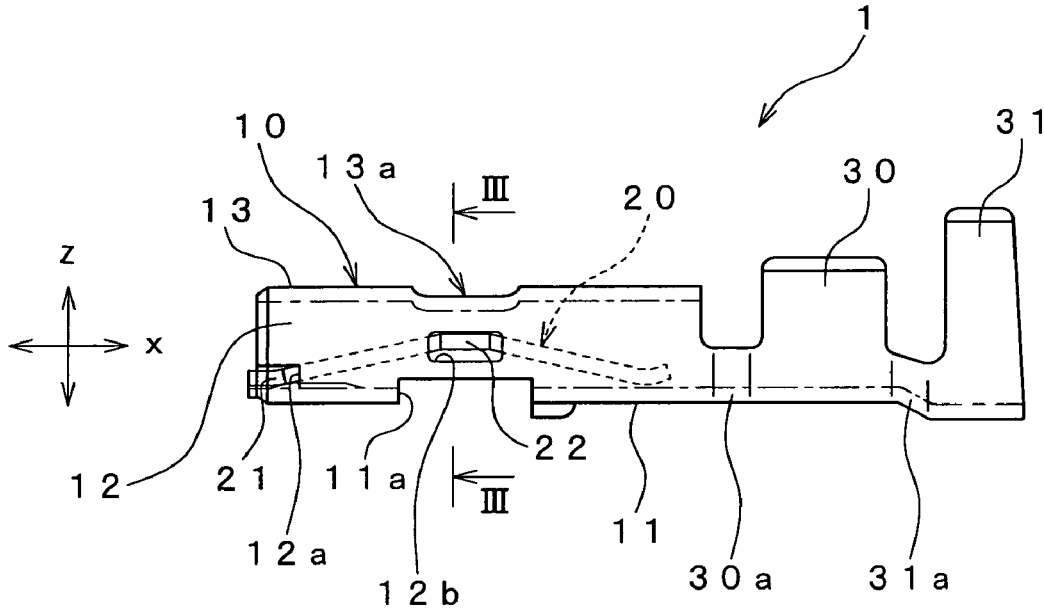
FIG. 2 is a side view of the female contact illustrated in FIG. 1 as seen from an under side of the drawing sheet of FIG. 1.

First, a female contact according to an embodiment of the present invention will be described with reference to FIGS. 1, 2, 3, and 4. In FIGS. 1 and 2, arrows x, y, and z which are perpendicular to one another stand respectively for lengthwise, widthwise, and vertical directions of a female contact 1 of the embodiment. The direction x follows a direction in which a male contact is inserted into or pulled out of the female contact 1, and the direction z follows a direction in which a later-described flat spring exerts its elastic force.

The female contact 1 comprises, from left to right in FIGS. 1 and 2, a socket 10, a conductor crimper 30, and an insulator crimper 31. The socket 10 has a substantially rectangular-cylindrical shape that is elongated in the direction x. The conductor crimper 30 is connected, via a connecting portion 30*a*, with one end of the socket 10. The insulator crimper 31 is connected, via a connecting portion 31*a*, with an end of the conductor crimper 30 on the side opposite to the connecting position 30*a*. The female contact 1 further includes a flat spring 20 held in the socket 10 in order to apply elastic force to a male contact that is accommodated in the socket 10. Respective parts of the female contact 1 are all made of the same conductive material, e.g., brass having relatively high elasticity.

An opening of the socket 10 provided at a left end thereof in FIGS. 1 and 2 forms a male-contact inlet through which a male contact is inserted into the socket 10.

The socket 10 has a bottom wall 11, two side walls 12, and a top wall 13. The bottom wall 11 is substantially rectangular in planar shape. The side walls 12 stand vertically upward from edges in the widthwise direction of the bottom wall 11, i.e., in the direction y. The top wall 13, which connects upper edges of the two side walls 12, is in parallel with the bottom wall 11. A space enclosed with the bottom wall 11, the side walls 12, and the top walls 13 forms a male-contact accommodation space.

As illustrated in FIG. 2, the bottom wall 11 of the socket 10 has an opening 11*a* formed substantially in its center. When a lance 50*a* provided in a housing 50 (see FIG. 4) in which the female contact 1 is housed comes into engagement with the opening 11*a*, the female contact 1 is latched to the housing 50 so that the female contact 1 can be prevented from falling out of the housing 50.

Notches 12*a* are formed at an edge of the socket 10 defining the male-contact inlet, which is formed by a left-hand opening in FIGS. 1 and 2. To be more specific, notches 12*a* are formed at lower portions near the bottom wall 11 of edges of the respective side walls 12 at the male-contact inlet, as illustrated in FIG. 2. Each side wall 12 has an opening 12*b* that is formed substantially in its center and is elongated in the direction x. The openings 12*b* locate more away from the male-contact inlet of the socket 10 than the notches 12*a* do and whose location are shifted from a location of the notches 12*a* with respect to the direction z.

As illustrated in FIG. 1, the top wall 13 of the socket 10 is provided with two recesses 13*a* each having an oval planar shape elongated in the direction x, which are formed side by side along the direction y. The recesses 13*a* is for increasing strength of the top wall 13.

The flat spring 20 elongated in the direction x has, in a plan view of FIG. 1, a substantially rectangular shape which is slightly smaller than the bottom wall 11 of the socket 10, and has, in a side view of FIG. 2, a convex shape whose top is formed by its middle in the lengthwise direction, i.e., the direction x.

One end of the flat spring 20 locates at the male-contact inlet of the socket 10. The flat spring 20 has, in the vicinity of the one end, a pair of hooks 21 that protrude out in the direction y. The hooks 21 are engaged with the notches 12*a* of the socket 10, thereby latching the flat spring 20 at the male-contact inlet of the socket 10. The one end of the flat spring 20 is in contact with the bottom wall 11 of the socket 10.

The flat spring 20 has, in the top of the convex, a pair of projections 22 that protrudes out in the direction y in the same manner as of the hooks 21. The projections 22 are engaged with the openings 12*b* formed in the side walls 12 of the socket 10. As illustrated in FIG. 2, a section of the projection 22 is smaller than the opening 12*b*. Therefore, the top of the convex of the flat spring 20 is movable in the direction z with the projections 22 being disposed in the openings 12*b*.

Figure 3:
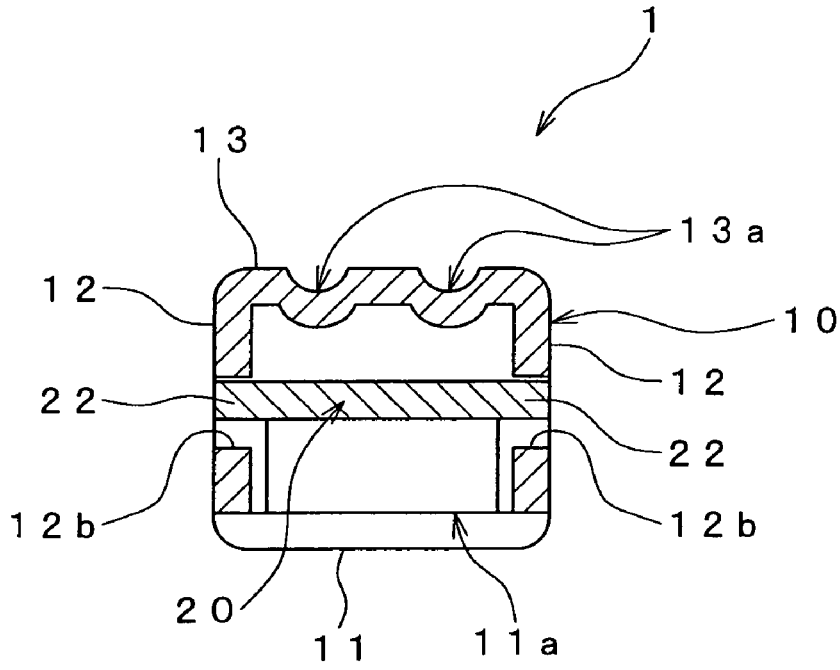
FIG. 3 is a sectional view taken along a line III—III illustrated in FIG. 2.

More specifically, when a male contact is not accommodated in the socket 10, the flat spring 20 are settled with the projections 22 being in contact with edges that define upper ends of the respective openings 12*b*, as illustrated in FIGS. 2 and 3. Along with insertion of a male contact, a front end of the male contact is pressing the top of the convex of the flat spring 20 which is thereby moved downward. During pullout of a male contact, the top of the convex of the flat spring 20 is moved upward into its original state, i.e., a state as shown in FIGS. 2 and 3. Such a movement of the flat spring 20 is limited in accordance with a size of the openings 12*b*. Thus, the projections 22 are movable in the vertical direction until they come into contact with edges that define upper and lower ends of the respective openings 12*b*.

The other end of the flat spring 20 locates downstream in a direction along which a male contact is inserted into the socket 10, i.e., left to right direction in the drawing sheet of FIGS. 1 and 2, and in other words, locates near the connecting portion 30*a*. The other end of the flat spring 20 is bent upward with its under surface being in contact with the bottom wall 11 of the socket 10. During insertion and pullout of a male contact, the other end of the flat spring 20 slides along the direction x while kept in contact with the bottom wall 11 of the socket 10.

Figure 4:
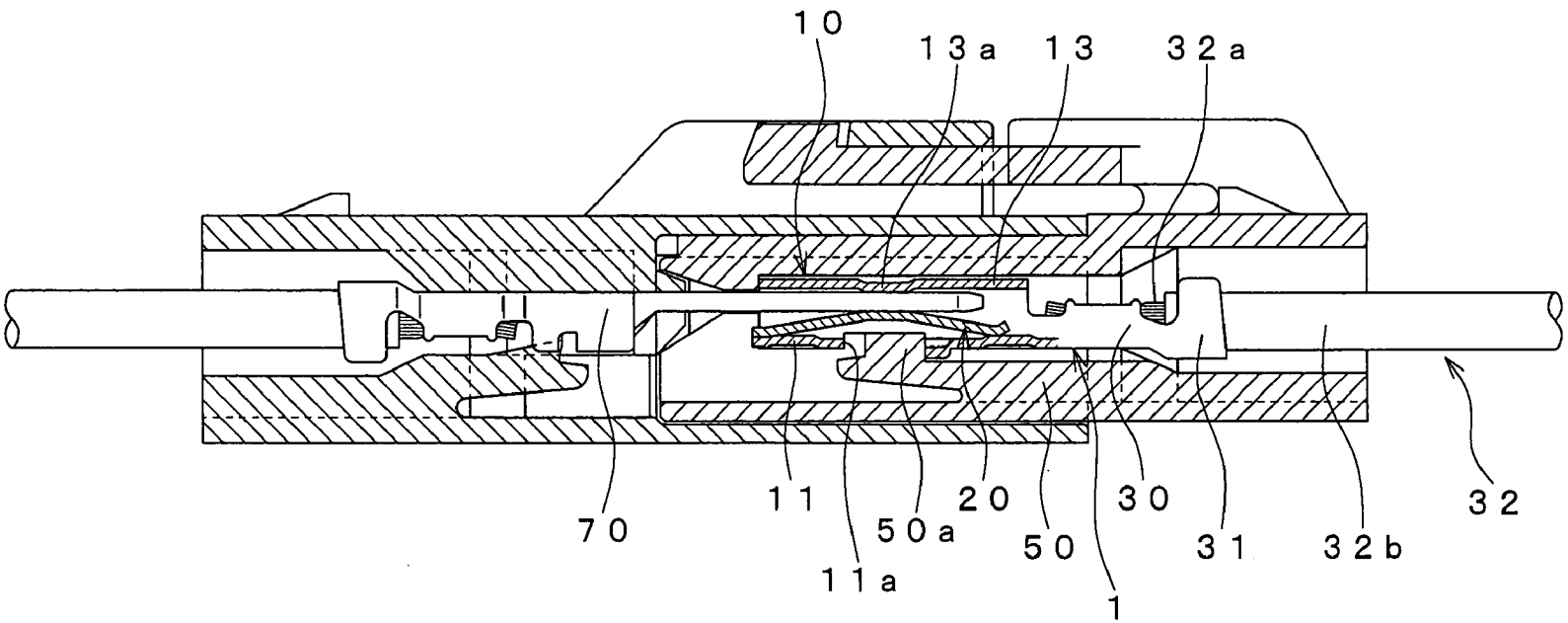
FIG. 4 shows a fragmentary vertical section of an apparatus mounted with the female contact of FIG. 1 in which a male contact is accommodated.

As illustrated in FIG. 4, a male contact 70 accommodated in the socket 10 is supported in a sandwich manner between the top of the convex of the flat spring 20 and a under surface of the top wall 13 where the recesses 13*a* are formed. Under this condition, the flat spring 20 exerts upward elastic force on the male contact 70, which enables the male contact 70 to be securely held in the socket 10. As a result, good electrical contact is kept between the contacts 1 and 70.

The conductor crimper 30 and the insulator crimper 31, each of which has a U-like shape with its top opened, are used to crimp and fix a conductor 32*a* and a insulating shell 32*b*, respectively, of an electric wire 32 which is mounted on the female contact 1, as illustrated in FIG. 4.

Next, an exemplary method for manufacturing the female contact 1 will be described with reference to FIGS. 5, 6, 7, 8, and 9. In the following example, there is adopted a flat plate 101 (see FIGS. 5 and 6) that has been obtained by punching a metallic plate such as brass plate having relatively high elasticity, and the female contact 1 is manufactured through a process such as bending and cutting the flat plate 101. In FIGS. 5 to 9, base elements that are intended to form respective parts of the female contact 1 of FIGS. 1 to 4 are each denoted by a reference number of one-hundred-something that is higher by 100 than a reference number denoting its corresponding part in FIGS. 1 to 4.

Figure 5:
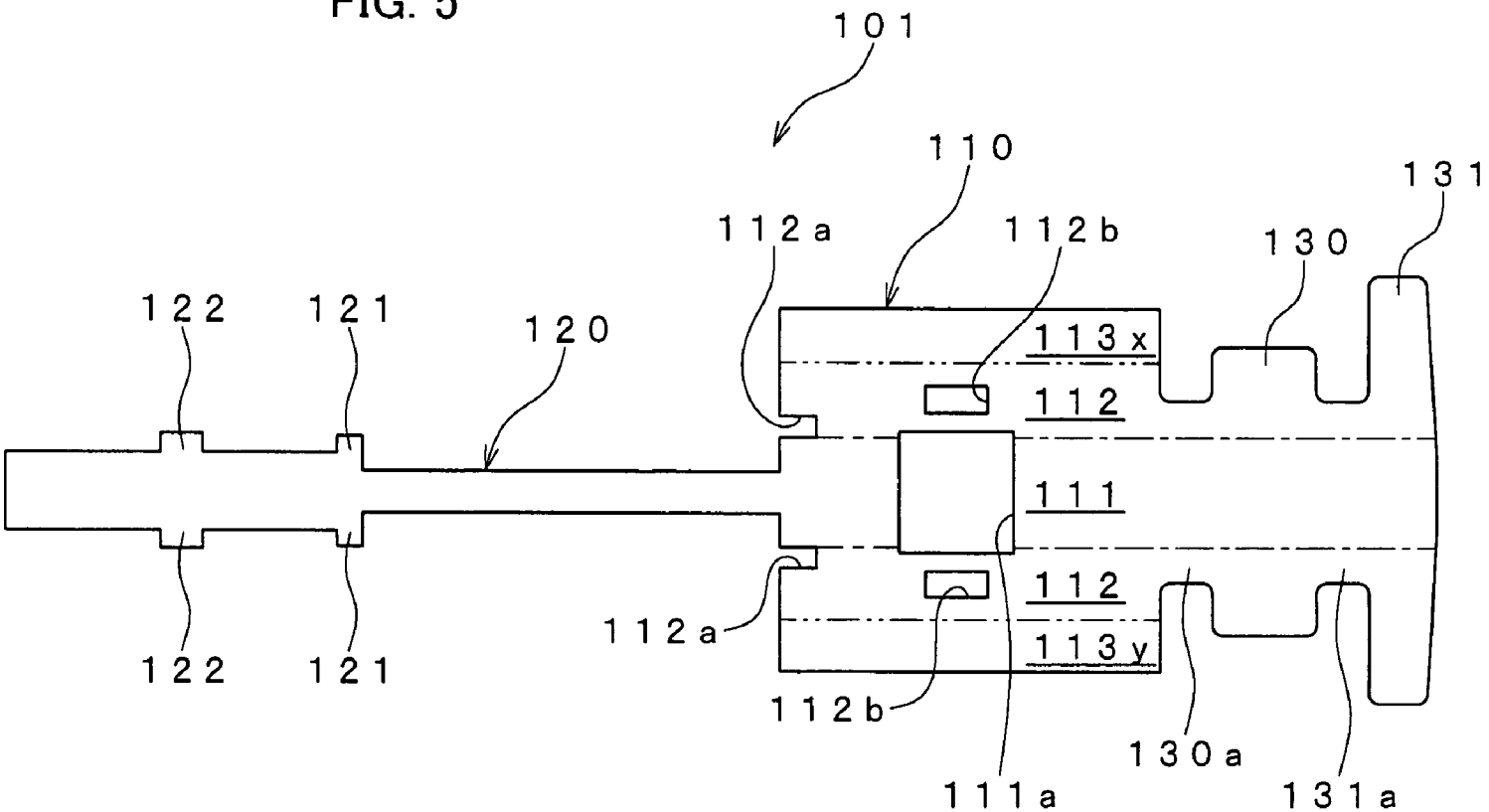
FIG. 5 is a plan view of a flat plate that is used to form the female contact of FIG. 1.
Figure 6:
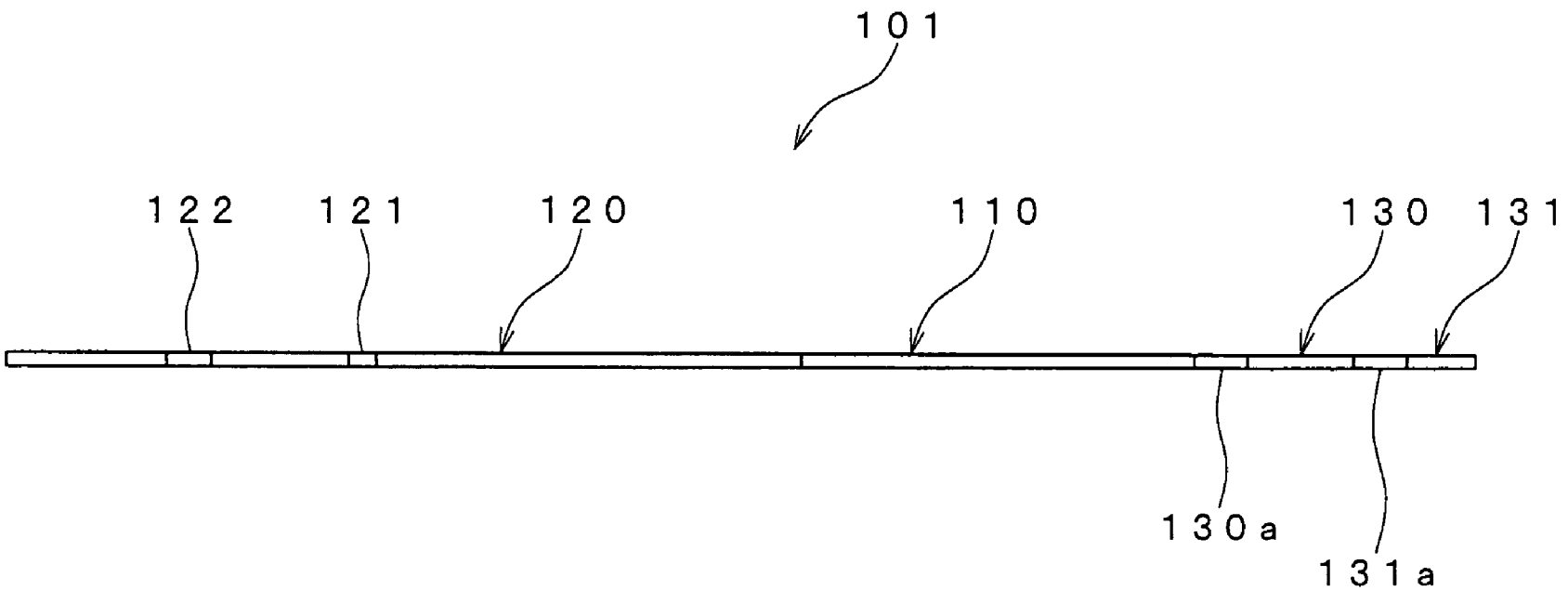
FIG. 6 is a side view of the flat plate illustrated in FIG. 5 as seen from an under side of the drawing sheet of FIG. 5.

The flat plate 101 shown in FIGS. 5 and 6 includes, from left to right in the drawing sheets, a spring element 120, a socket element 110, a conductor crimper element 130, and an insulator crimper element 131. The spring element 120 is elongated in a horizontal direction of FIGS. 5 and 6. The socket element 110 has a substantially square shape and is connected, in the middle of one edge thereof, with the spring element 120. In the middle of an opposite edge of the socket element 110, the conductor crimper element 130 is connected with the socket element 110 via a connecting portion 130*a*. The conductor crimper element 130 is elongated in a direction perpendicular to an elongation direction of the spring element 120. The insulator crimper element 131 is connected with the conductor crimper element 130 via a connecting portion 131*a* that locates opposite to the connecting portion 130*a* across the conductor crimper element 130. The insulator crimper element 131 is more elongated in the direction perpendicular to the elongation direction of the spring element 120 than the conductor crimper element 130 is.

The spring element 120 has, from its lengthwise middle to its free end, a pair of hooks 121 and a pair of projections 122, which are paired in a widthwise direction of the spring element 120, respectively, and are spaced away from each other in the lengthwise direction of the spring element 120. The spring element 120 has a reduced width between the hooks 121 and the socket element 110.

A substantially square opening 111*a* is formed in a center of the socket element 110. Two openings 112*b* elongating in the elongation direction of the spring element 120 are formed symmetrically with respect to the opening 111*a* in the direction perpendicular to the elongation direction of the spring element 120. The socket element 110 has two notches 112*a* near a portion where the spring element 120 is connected thereto. The two notches 112*a* are formed symmetrically in the direction perpendicular to the elongation direction of the spring element 20.

The flat plate 101 is subjected to a series of bendings as will be described below. In the following description, a direction running perpendicularly through the drawing sheet of FIG. 5 is defined as a "vertical direction", and a face of the flat plate 101 visible in FIG. 5 is defined as a "surface".

Figure 7:
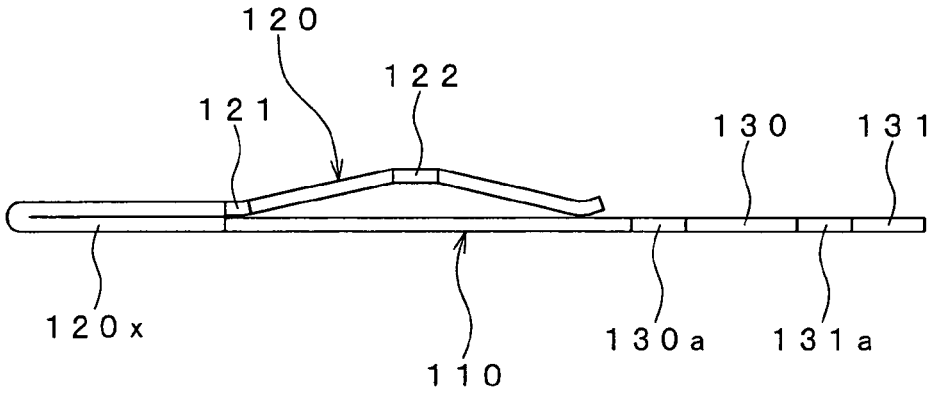
FIG. 7 is a side view showing a state where a spring element of the flat plate illustrated in FIG. 5 is bent over and partially bent into a convex shape in process of manufacturing the female contact of FIG. 1.

First, the spring element 120 is bent into such a shape as shown in FIG. 7. More specifically, the spring element 120 is bent 180 degrees towards the socket element 110 so as to establish a confrontation between the hooks 121 and the notches 112*a* of the socket element 110 and also establish a surface-to-surface contact between the socket element 110 and the spring element 120. Then, a portion of the spring element 120 confronting the socket element 110, which means a portion between the hooks 121 and its free end, is bent into a convex shape protruding upward, in such a manner that the pair of projections 122 confronts the opening 111*a* of the socket element 110 and at the same time locates at a top of the convex. Then, a front end of the spring element 120 is bent upward so that its under surface can be in contact with a surface of the socket element 110. Here, a portion 120*x*, which is a part of the spring element 120 other than the convex portion, i.e., other than a front portion including the hooks 121 and the projections 122, is folded so that surfaces of its folded two parts contact with each other along substantially on the same plane as the socket element 110 and other elements which have not been bent yet.

Figure 8:
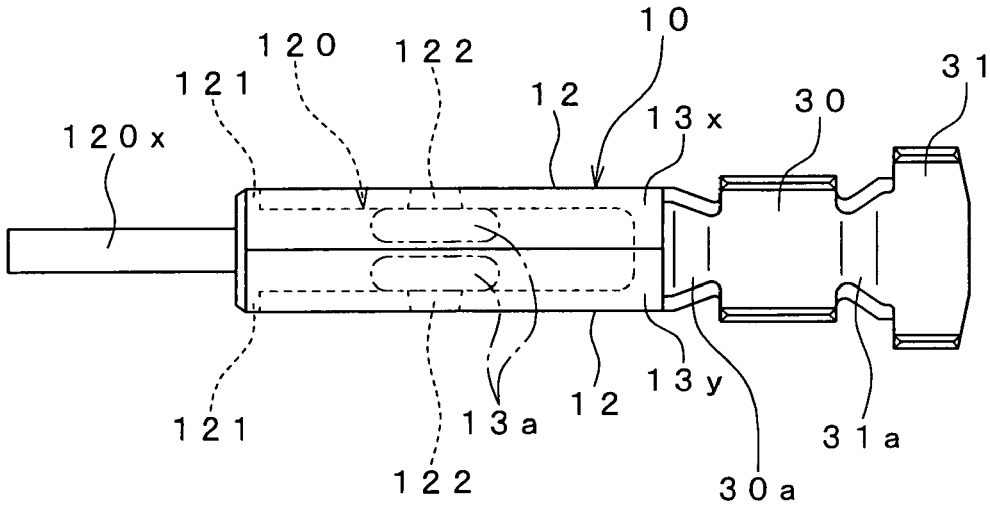
FIG. 8 is a plan view showing a state where a socket element of the flat plate illustrated in FIG. 5 is formed into a tube-like shape and a conductor crimper element and an insulator crimper element of the flat plate are formed into U-like shapes in process of manufacturing the female contact of FIG. 1.
Figure 9:
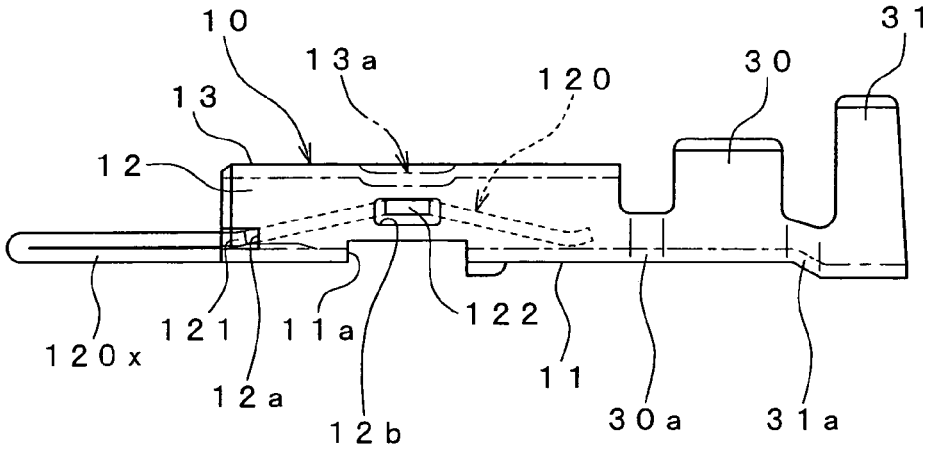
FIG. 9 is a side view of the half-manufactured female contact illustrated in FIG. 8 as seen from an under side of the drawing sheet of FIG. 8.
Figure 10:
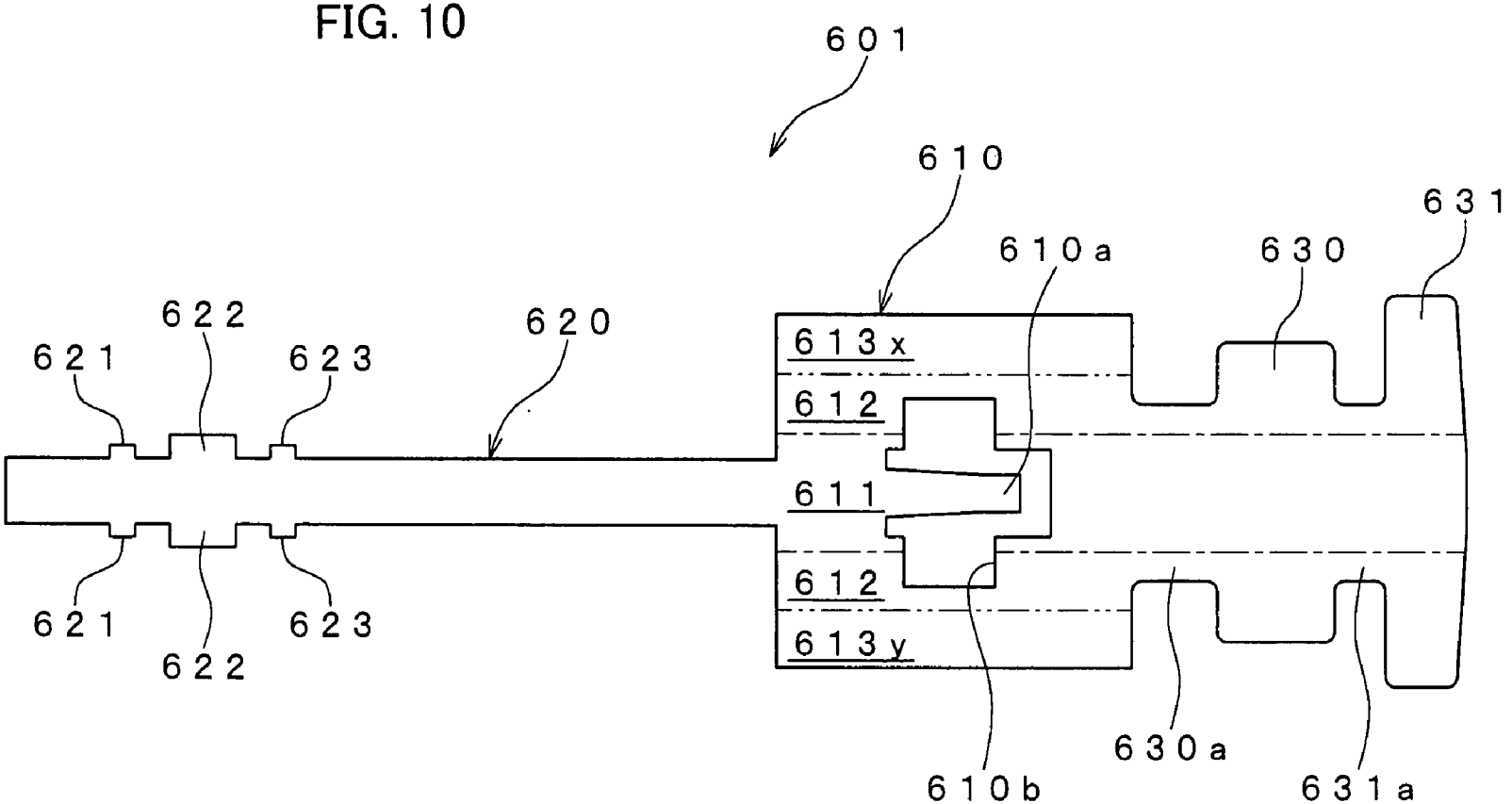
FIG. 10 is a plan view of a flat plate that is used to form a conventional female contact.
Figure 11:
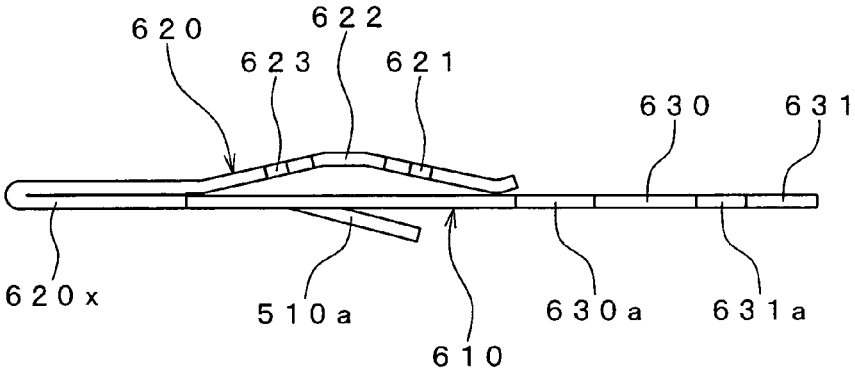
FIG. 11 is a side view showing a state where a spring element of the flat plate illustrated in FIG. 10 is bent over and partially bent into a convex shape in process of manufacturing the conventional female contact.
Figure 12:
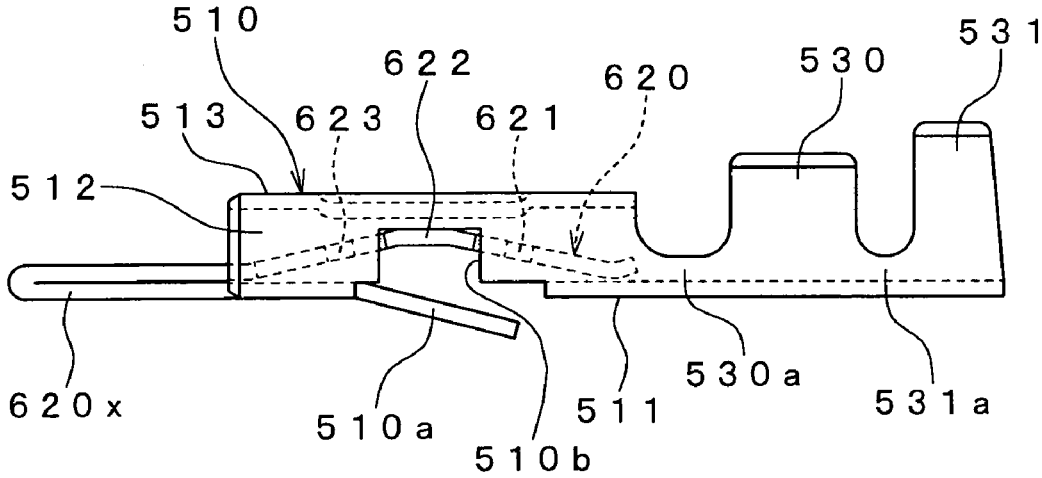
FIG. 12 is a side view showing a state where a socket element of the flat plate illustrated in FIG. 10 is formed into a tube-like shape and a conductor crimper element and an insulator crimper element of the flat plate are formed into U-like shapes in process of manufacturing the conventional female contact.
Figure 13:
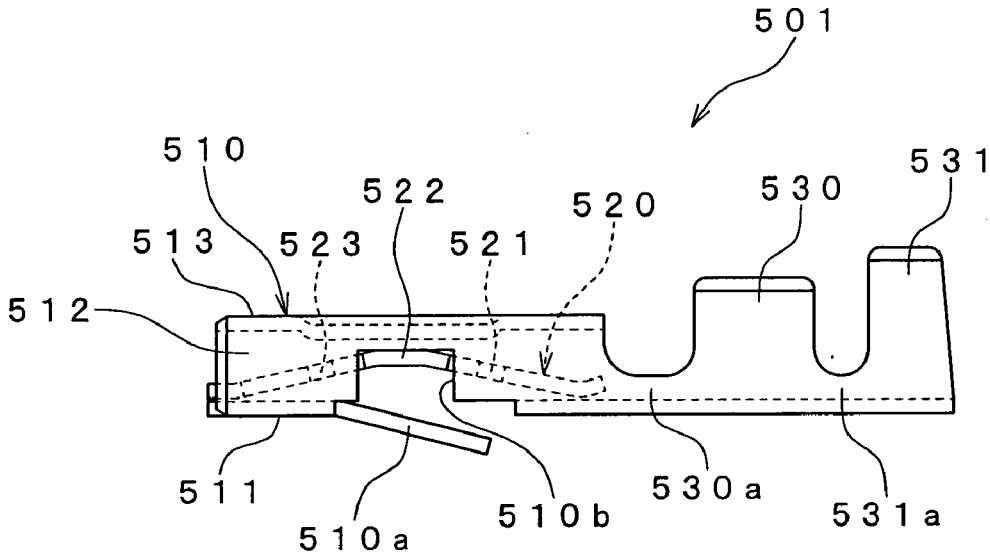
FIG. 13 is a side view of the conventional female contact.

Next, the socket element 110, the conductor crimper element 130, the insulator crimper element 131, the connecting portion 130*a*, and the connecting portion 131*a* shown in FIG. 5 are bent into respective shapes as shown in FIGS. 8 and 9. In FIGS. 8 and 9, the respective elements 110, 130, 131, 130*a*, and 131*a* are already in finished forms, and therefore denoted by the reference numbers 10, 30, 31, 30*a*, and 31*a*, which are the same as in FIGS. 1 to 4.

To be more specific, the socket element 110, the conductor crimper element 130, the insulator crimper element 131, the connecting portion 130*a*, and the connecting portion 131*a* shown in FIG. 5 are all bent along alternate long and short dash lines which then form bottoms of valleys. Portions of the socket element 110 outside the alternate long and short dash lines, i.e., portions 112, 113*x*, and 113*y* which are intended to form the side walls 12 and the top wall 13 of the socket 10 are standing perpendicularly to a plane defined by the flat plate 101, and the projections 122 and the hooks 121 of the spring element 120 are brought into engagement with the openings 112*b* and the notches 112*a*, respectively. Then, portions 113*x* and 113*y* of the socket element 110 which are outside the alternate long and two short dashes lines are bent inward so that their edges confront each other and they are laid in parallel with the bottom wall 11 of the socket 10. The edges of the portions 113*x* and 113*y* are in abutment with each other, to thereby form the top wall 13 of the socket 10. Then, two recesses 13*a* are formed in a portion of the top wall 13 confronting the top of the convex of the flat spring 20. Through the above-described process, formed is the socket 10 having a substantially rectangular-cylindrical shape and including the bottom wall 11, the side walls 12, and the top wall 13 which altogether enclose therein the convex portion of the spring element 120.

The conductor crimper element 130, the insulator crimper element 131, the connecting portion 130*a*, and the connecting portion 131*a* are, differently from the socket element 110 which is shaped into a rectangular-cylindrical shape, each formed into a U-like shape with its top opened, thereby forming the conductor crimper 30, the insulator crimper 31, the connecting portion 30*a*, and the connecting portion 31*a* as shown in FIGS. 8 and 9.

Finally, a portion of the spring element 120 extending out of the socket 10 in FIGS. 8 and 9, i.e., the portion 120*x* which is a part of the spring element 120 other than the convex portion, is cut away. The remaining convex portion of the spring element 120 forms the flat spring 20, thus completing the female contact 1 that has the flat spring 20 held in the socket 10.

In the female contact 1 of the present invention, as thus far described, the hooks 21 of the flat spring 20 are engaged with the notches 12*a* of the socket 10, thereby latching the flat spring 20 to the socket 10. Thus, the flat spring 20 is, via its hooks 21, latched at the male-contact inlet of the socket 10. Accordingly, even if a checking rod, which is inserted through the male-contact inlet into the socket 10 for checking continuity, is in contact with the one end of the flat spring 20 at the male-contact inlet, the flat spring 20 is unlikely to deform and therefore can be prevented from deteriorating in elasticity.

The socket 10 has the openings 12*b* which locate more away from the male-contact inlet than the notches 12*a* do and whose location are shifted from the location of the notches 12*a* with respect to the direction in which the flat spring 20 exerts its elastic force, i.e., with respect to the direction z. In addition, the flat spring 20 has the projections 22 engageable with the openings 12*b* in such a way that they are, during insertion and pullout of a male contact into and from the socket 10, movable within the openings 12*b* in the direction of exertion of elastic force, i.e., in the direction z. Such a movement of the flat spring 20 comes to limit upon contact between the projections 22 and the edges that define the openings 12*b*. This allows proper elastic force to be applied to the male contact 70. Moreover, since the flat spring 20 has not only the hooks 21 but also the projections 22, a shape of the flat spring 20 becomes more stable as compared with being latched to the socket 10 via the hooks 21 alone. As a result, the flat spring 20 can keep proper elastic force against the male contact 70.

Besides, the notches 12*a*, the openings 12*b*, the hooks 21, and the projections 22 are each formed in an opposite pair with respect to the direction y that is perpendicular to the direction z in which the flat spring 20 exerts elastic force and also perpendicular to the direction x in which a male contact is inserted and pulled out. Like this, holes and protrusions which are engaged with each other are each formed in an opposite pair with respect to the aforementioned direction, thereby providing more stable holding of the flat spring 20 in the socket 10, and also stabilization of elastic force of the flat spring 20 exerted on the male contact 70.

Differently from the present embodiment, when a hole engageable with the hook 21 of the flat spring 20 is configured as a through-hole entirely enclosed by a wall element, the through-hole can be formed near the male-contact inlet but not at the end of the socket 10. In this embodiment, however, since a hole engageable with the hook 21 is configured as the notch 12*a* that is formed at the edge of the socket 10 defining the male-contact inlet, the flat spring 20 can be latched at the end of the socket 10 where the male-contact inlet is formed. From the viewpoint of reducing deformation of the flat spring 20 due to a checking rod in contact with the one end of the flat spring 20 at the male-contact inlet, it is more effective that the flat spring 20 is latched via the notches 12*a* at the end of the socket 10 as in this embodiment.

Also differently from the present embodiment, when a gap exists between the bottom wall 11 of the socket 10 and the one end of the flat spring 20 at the male-contact inlet, a checking rod for continuity check may be inserted through the gap by mistake, with the result of failing to check continuity and furthermore causing a problem of deformation of the flat spring 20. In this embodiment, on the other hand, the one end of the flat spring 20 at the male-contact inlet, where the hooks 21 are formed, is in contact with the bottom wall 11 of the socket 10 in the vicinity of the male-contact inlet. That is, almost no gap is formed between the flat spring 20 and the socket 10 in the vicinity of the male-contact inlet. Accordingly, a checking rod can be prevented from being inserted into such a gap.

The flat spring 20 has a convex shape, and the other end of the flat spring 20 opposite to the male-contact inlet is in contact with the bottom wall 11 of the socket 10. Thus, the flat spring 20 is, when applying elastic force on the male contact 70, supported on the socket at two points, i.e., the one end at the male-contact inlet and the other end opposite thereto which locates downstream in the direction of insertion of a male contact. Since such a two-point support gives larger elastic force compared with a one-point support, the male contact 70 can more securely be held in the socket 10.

The other end of the convex-shaped flat spring 20 opposite to the male-contact inlet may not necessarily be in contact with the bottom wall 11 of the socket 10. In this case, the flat spring 20 is supported on the socket 10 at the one end thereof.

The one end of the flat spring 20 at the male-contact inlet may not necessarily be in contact with the bottom wall 11 of the socket 10. For example, the one end of the flat spring 20 may be engaged with notches that are formed by shifting the notches 12*a* in the direction z to locate in the middle of the edge of the side wall 12. In this case, since a gap appears between the flat spring 20 and the socket 10 at the male-contact inlet, a checking rod may be inserted into the gap. However, even if the checking rod is inserted into the gap, the flat spring 20 hardly incurs deformation because it is latched via the notches in the vicinity of the male-contact inlet of the socket 10.

A hole engageable with the hook 21 of the flat spring 20 is not limited to the notch 12*a*, but may be a through-hole entirely enclosed by a wall element, a recess, or the like.

It is not always required that the notch 12*a*, the opening 12*b*, the hook 21, and the projection 22 are formed in pairs.

The projections 22 formed at the convex top of the flat spring 20 can be omitted. The flat spring 20 can be held in the socket 10 even without the projections 22, because the flat spring 20 is latched to the socket 10 via the hooks 21. When the projections 22 and the openings 12*b* are omitted from the socket 10 and the flat spring 20, respectively, a relatively simple structure is provided.

The flat spring 20 can take various shapes instead of the convex as in the above embodiment, as long as it can apply elastic force to the male contact 70 accommodated in the socket 10. In addition, the hook 21 of the flat spring 20 can also be changed variously.

A shape of the socket 10 is not limited to the above-described rectangular cylinder but may be a circular cylinder or the like, as long as it is a tube-like shape with a wall for defining a space for accommodating the male contact 70.

Although, in the above-described method for manufacturing the female contact 1, a single flat plate 101 has been adopted, the socket 10 and the flat spring 20 can be independently formed from separate members, followed by assembling of the flat spring 20 into the socket 10. Moreover, the parts of the female contact 1 need not always be made of the same material but may be made of different materials.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A female contact comprising:

a tube-shaped socket having a wall that defines a male-contact accommodation space and also having, at one end thereof, a male-contact inlet in the vicinity of which a first hole is formed; and a flat spring that is held in the accommodation space so as to apply elastic force to a male contact received in the accommodation space, the flat spring having one end thereof positioned at the male-contact inlet and having, in the vicinity of the one end, a first protrusion engageable with the first hole, wherein a recess that projects into the accommodation space is formed in a portion of the wall confronting the flat spring, wherein an aperture is formed in a portion of the wall confronting the flat spring opposite the recess and wherein the aperture partially extends up both side walls, and wherein the tube-shaped socket and the flat spring are separate pieces.

2. The female contact according to claim 1, wherein:

the socket further has a second hole located further from the male-contact inlet than the first hole and whose location is shifted from a location of the first hole with respect to a direction of exertion of the elastic force; and the flat spring further has a second protrusion engageable with the second hole in such a manner that it can be movable within the second hole in the direction of exertion of the elastic force during insertion and pullout of a male contact into and from the accommodation space.

3. The female contact according to claim 2, wherein the first hole, the second hole, the first protrusion, and the second protrusion are each formed in an opposite pair with respect to a direction that is perpendicular to the direction of exertion of the elastic force and also perpendicular to a direction in which a male contact is inserted into and pulled out of the accommodation space.

4. The female contact according to claim 1, wherein the first hole is a notch that is formed at an edge of the wall defining the male-contact inlet.

5. The female contact according to claim 1, wherein the one end of the flat spring is in contact with the wall in the vicinity of the male-contact inlet.

6. The female contact according to claim 1, wherein the flat spring has a convex shape, and the other end of the flat spring is in contact with the wall.

7. A female contact comprising:

a socket configured to accommodate a male contact therein, wherein a first recess is disposed at a distal end portion of the socket to form a portion of an inlet of the socket; and a spring member disposed in the socket and extending in a longitudinal direction of the socket, wherein the spring member comprises a first protrusion disposed at an end portion thereof, and wherein the first protrusion is engaged with the first recess, wherein an aperture is formed in a portion of the wall confronting the flat spring opposite the recess and wherein the aperture partially extends up both side walls.

8. The female contact according to claim 7, wherein the socket and the spring member are separate pieces.

9. The female contact according to claim 7, wherein a second recess is disposed on a side wall of the socket and away from the inlet in the longitudinal direction, and wherein the spring member further comprises a second protrusion configured to be engaged with the second recess.

10. The female contact according to claim 6, wherein the recess is formed in a portion of the wall confronting an apex of the flat spring.

* * * * *